US011534903B2

(12) United States Patent
Smith

(10) Patent No.: US 11,534,903 B2
(45) Date of Patent: Dec. 27, 2022

(54) POWER TOOL TWO-STAGE TRIGGER

(71) Applicant: APEX BRANDS, INC., Apex, NC (US)

(72) Inventor: Steven Craig Smith, Irmo, SC (US)

(73) Assignee: APEX BRANDS, INC., Apex, NC (US)

( * ) Notice: Subject to any disclaimer, the term of this patent is extended or adjusted under 35 U.S.C. 154(b) by 125 days.

(21) Appl. No.: 16/641,357

(22) PCT Filed: Aug. 27, 2018

(86) PCT No.: PCT/US2018/048052
§ 371 (c)(1),
(2) Date: Feb. 24, 2020

(87) PCT Pub. No.: WO2019/046144
PCT Pub. Date: Mar. 7, 2019

(65) Prior Publication Data

US 2020/0223050 A1 Jul. 16, 2020

Related U.S. Application Data

(60) Provisional application No. 62/550,864, filed on Aug. 28, 2017.

(51) Int. Cl.
*B25F 5/02* (2006.01)
*B25F 5/00* (2006.01)
*B25B 21/02* (2006.01)

(52) U.S. Cl.
CPC ..... *B25F 5/02* (2013.01); *B25F 5/001* (2013.01); *B25B 21/02* (2013.01);
(Continued)

(58) Field of Classification Search
CPC .... B25F 5/02; B25F 5/001; B25F 5/00; B25B 21/02; B25D 2250/121; B25D 2250/221; B25D 2250/265
(Continued)

(56) References Cited

U.S. PATENT DOCUMENTS 3,072,768 A * 1/1963 Happe ..... H01H 13/08 200/522
3,610,505 A * 10/1971 Males ..... B25C 5/10 227/127

(Continued)

FOREIGN PATENT DOCUMENTS

EP 2929986 A2 10/2015

OTHER PUBLICATIONS

International Search Report and Written Opinion from International Application No. PCT/US2018/048052 filed on Aug. 27, 2018, all pages cited in it's entirety.

*Primary Examiner* — Robert F Long
(74) *Attorney, Agent, or Firm* — Burr & Forman LLP

(57) ABSTRACT

A power tool (130) may include an end effector (200) configured to engage an object to be worked by the tool, a power unit (230), a drive assembly (210) configured to drive the end effector responsive to application of input power thereto, and a motor (220) configured to supply the input power to the drive assembly selectively based on operation of a power control assembly (240) that controls coupling of the motor to the power unit. The power control assembly includes a trigger (300) having a full range of motion (310) between a rest position and an actuated position. The power control assembly further defines a transition point (316) between a first region (312) and a second region (314) of the full range of motion. The power control assembly includes a first biasing assembly (330) that opposes movement of the
(Continued)

trigger in the first region, and a second biasing assembly (340) that opposes movement of the trigger at least at the transition point.

20 Claims, 8 Drawing Sheets

(52) U.S. Cl.
CPC .. *B25D 2250/121* (2013.01); *B25D 2250/221* (2013.01); *B25D 2250/265* (2013.01)

(58) Field of Classification Search
USPC ..... 173/1–11, 13–21, 170, 141, 160–161
See application file for complete search history.

(56) References Cited

U.S. PATENT DOCUMENTS 4,158,970 A * 6/1979 Laughon ..... B23B 45/008 173/48
5,163,598 A * 11/1992 Peters ..... A61B 17/0686 227/124
5,419,745 A * 5/1995 Moolenaar ..... B25B 23/14 477/178
5,443,196 A * 8/1995 Burlington ..... B25C 1/06 173/124
5,531,279 A * 7/1996 Biek ..... B25B 21/02 173/178
5,704,433 A * 1/1998 Bourner ..... B25B 23/14 173/178
5,868,208 A * 2/1999 Peisert ..... B23Q 5/04 173/178
6,010,426 A * 1/2000 Nakamura ..... B25F 5/001 188/189
6,135,212 A * 10/2000 Georgiou ..... B25B 21/02 173/48
6,178,853 B1 * 1/2001 Huang ..... B25B 21/02 173/93.5
6,375,171 B1 * 4/2002 Zimmermann ..... B25F 5/006 267/137
6,460,629 B2 * 10/2002 Bookshar ..... B25B 21/00 173/176
6,923,268 B2 * 8/2005 Totsu ..... B25B 21/00 173/170
10,014,128 B2 * 7/2018 Kannan ..... H01H 9/22
2003/0037939 A1 * 2/2003 Taga ..... B25B 21/02 173/93.5
2004/0040727 A1 * 3/2004 Miller ..... B25B 21/00 173/2
2006/0096767 A1 * 5/2006 Miller ..... B25B 21/00 173/2
2006/0124331 A1 * 6/2006 Stirm ..... F16D 43/208 173/178
2006/0157260 A1 7/2006 Greese
2007/0144753 A1 * 6/2007 Miller ..... B25F 5/026 173/217
2010/0146797 A1 * 6/2010 Dreher ..... B23D 45/16 30/228
2010/0170931 A1 * 7/2010 Viola ..... A61B 17/068 227/175.1
2011/0272448 A1 * 11/2011 Scirica ..... A61B 17/07207 227/175.2
2011/0278035 A1 * 11/2011 Chen ..... H02P 23/20 173/170
2012/0152579 A1 6/2012 Roehm
2014/0042838 A1 2/2014 Feridouni
2014/0174772 A1 * 6/2014 Mandalka ..... B25F 5/02 173/1
2015/0060100 A1 * 3/2015 Monroy ..... B25F 5/029 173/217
2015/0245834 A1 * 9/2015 Scirica ..... A61B 17/2909 227/176.1
2015/0279592 A1 * 10/2015 Ekstrom ..... H01H 21/24 200/522
2016/0001435 A1 * 1/2016 Watford ..... B23Q 11/04 173/1
2016/0176037 A1 * 6/2016 Hirai ..... B25F 5/006 173/162.2
2016/0351355 A1 12/2016 Hozumi
2018/0021933 A1 * 1/2018 Cheng ..... B25B 21/00 173/169

* cited by examiner

POWER TOOL TWO-STAGE TRIGGER

CROSS REFERENCE TO RELATED APPLICATIONS

This application claims priority to U.S. application No. 62/550,864 filed Aug. 28, 2017, the entire contents of which are hereby incorporated by reference in its entirety.

TECHNICAL FIELD

Example embodiments generally relate to power tools and, in particular, relate to a power tool having a two-stage trigger.

BACKGROUND

Power tools are commonly used across all aspects of industry and in the homes of consumers. Power tools are employed for multiple applications including, for example, drilling, tightening, sanding, and/or the like. Handheld power tools are often preferred, or even required, for jobs that require a high degree of freedom of movement or access to certain difficult to reach objects.

In some specific industries, such as, but not limited to the aerospace industry and the automotive industry, the operation and use of power tools may be subject to particular constraints. The constraints may include constraints from an ergonomic perspective relative to size and weight. In some cases, constraints may be introduced from an access perspective relative to reaching a required area for operation. In some other cases, constraints may be introduced from a process control perspective to ensure that the correct tool is being used in the correct manner, or that the correct amount of tightening is employed.

A typical handheld power tool is a fully self-contained unit with a motor and gearing to drive some sort of end effector for a specific application. Power for the tool may be provided via a power source such as an air supply, batteries or mains power. However, the motor and gearing that is powered by the power source is generally all provided in the same product or unit. As such, these self-contained units can be very portable and powerful relative to gaining access to objects and performing tightening operations thereon. However, in many cases these tools may have a simple on/off trigger that is either fully on or fully off dependent upon the position in which the operator places the trigger. This may make operation of the tool less efficient or even cumbersome for some situations.

Accordingly, it may be desirable to continue to develop improved mechanisms by which to implement controls for hand tools so that both the user experience and the effectiveness of the tool may be enhanced.

BRIEF SUMMARY OF SOME EXAMPLES

Some example embodiments may enable the provision of a power tool that has a two-stage trigger. The two-stage trigger may provide improved control over operation of the tool. For example, a first stage may have configurable (e.g., by the operator or factory) operation characteristics associated therewith, and a second stage may have configurable (e.g., again either by the operator or at the factory) operation characteristic associated therewith, which can be different than the operation characteristics associated with the first stage. Some example embodiments may therefore provide for improved progressivity of actuation or other aspects of control, efficiency or effectiveness of the tool.

In an example embodiment, a power tool is provided. The power tool may include an end effector configured to engage an object to be worked by the tool, a power unit, a drive assembly configured to drive the end effector responsive to application of input power thereto, and a motor configured to supply the input power to the drive assembly selectively based on operation of a power control assembly that controls coupling of the motor to the power unit. The power control assembly includes a trigger having a full range of motion between a rest position and an actuated position. The power control assembly further defines a transition point between a first region and a second region of the full range of motion. The power control assembly includes a first biasing assembly that opposes movement of the trigger in the first region, and a second biasing assembly that opposes movement of the trigger at least at the transition point.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

Figure 4A:
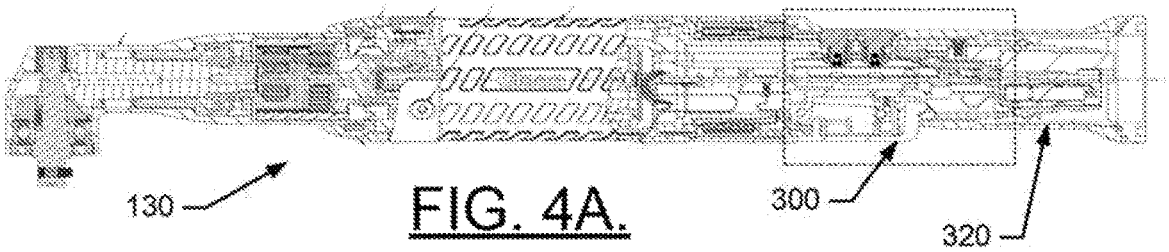
Figure 4B:
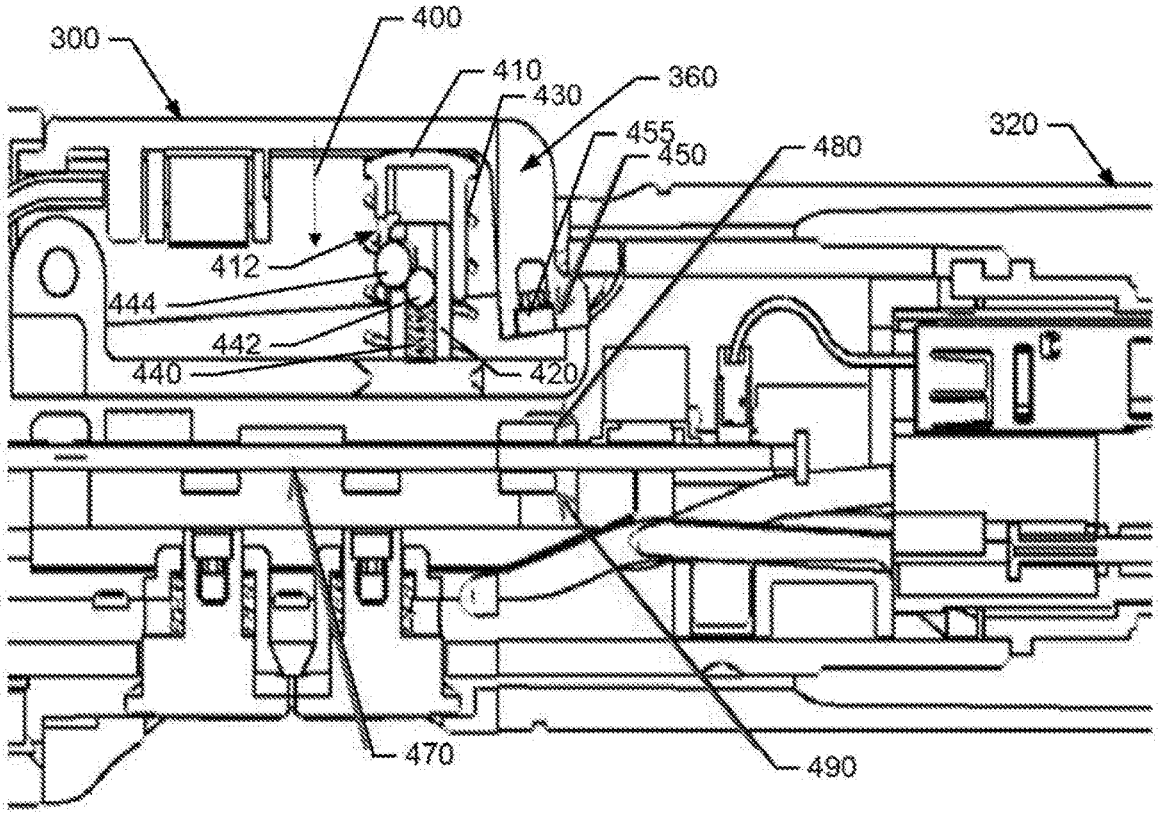
Figure 6:
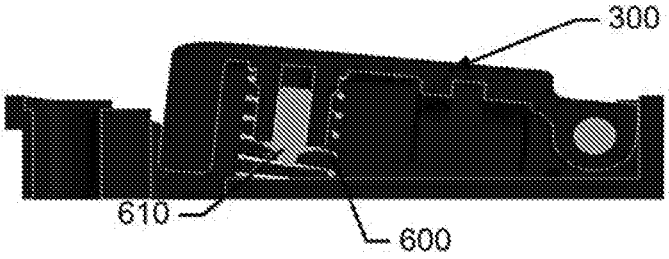
Figure 7A:
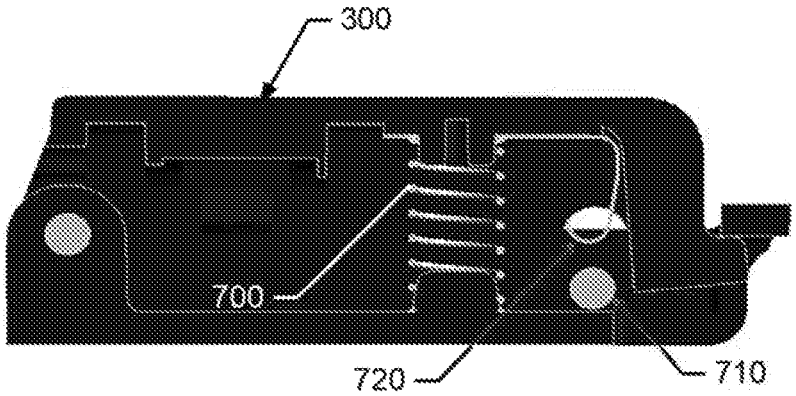
Figure 7B:
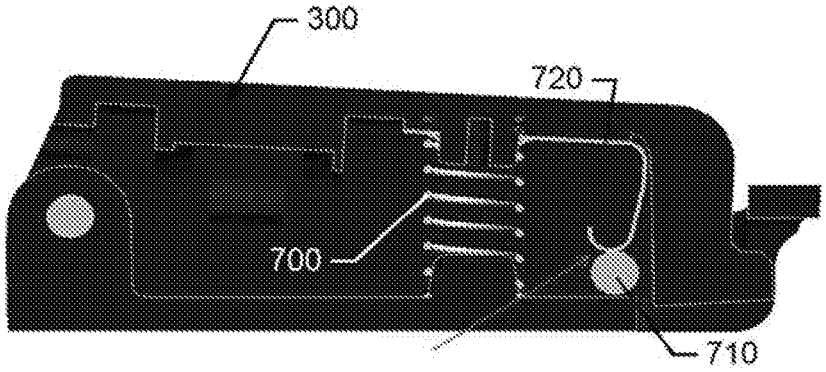
Figure 7C:
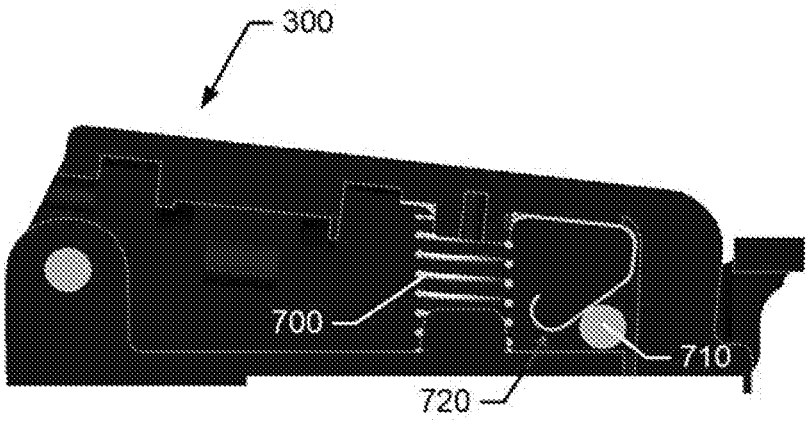

FIG. 4, which is defined by FIGS. 4A and 4B, illustrates a cross section view of a power tool and a handle portion of the power tool, respectively, in accordance with an example embodiment;

FIG. 5, which is defined by FIGS. 5A, 5B, 5C, and 5D, shows views of the trigger moving through a full range of motion in accordance with an alternative example embodiment;

FIG. 6 illustrates a cross section view of an alternative second biasing assembly in accordance with an example embodiment; and FIG. 7, which is defined by FIGS. 7A, 7B, and 7C, illustrates a cross section view of another alternative second biasing assembly in accordance with an example embodiment.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Figure 1:
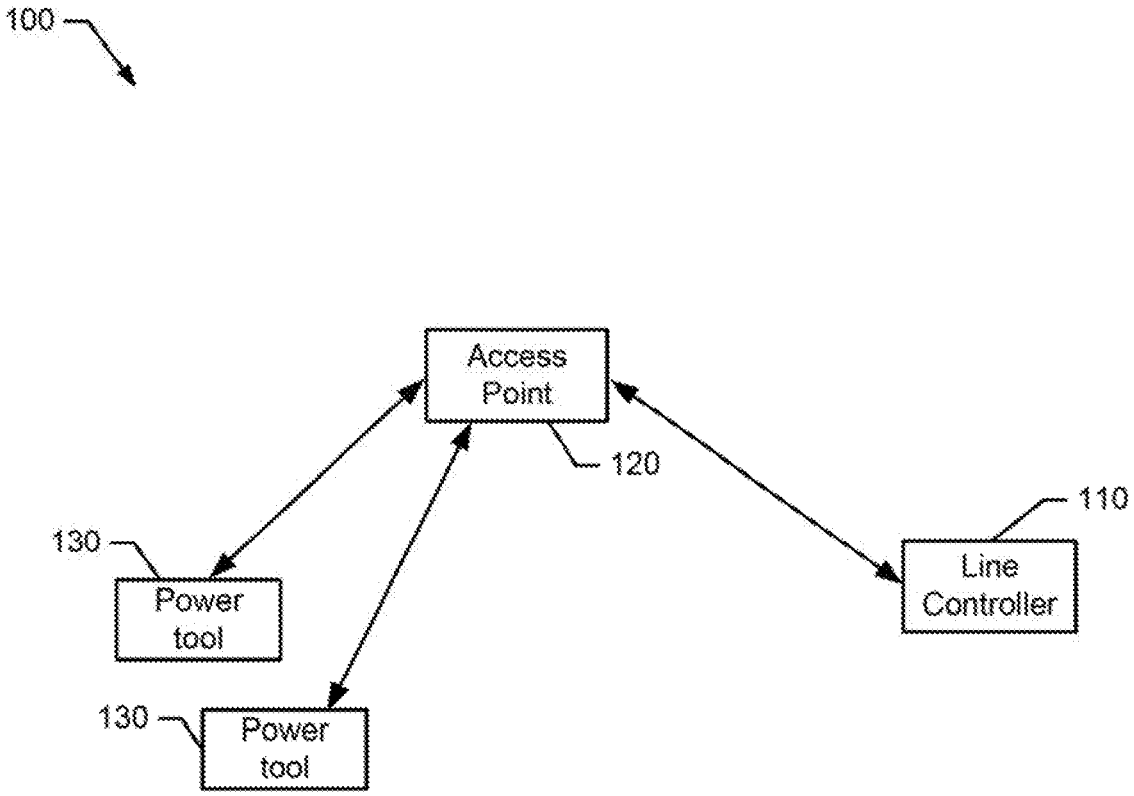
FIG. 1 illustrates a functional block diagram of a system that may be useful in connection with providing a system and power tool according to an example embodiment.

As indicated above, some example embodiments may relate to the provision of a power tool that incorporates an improved trigger. Such a tool may be part of a system for operation of power tools, or may operate in a stand-alone capacity independent of other system components. FIG. 1 illustrates a functional block diagram of a system that may be useful in connection with providing a system and power tool according to an example embodiment. However, it should be appreciated, again, that the power tool(s) shown in FIG. 1 need not necessarily operate in a system environment.

As shown in FIG. 1, a system 100 of an example embodiment may include a line controller 110, an access point 120 and one or more power tools 130. The line controller 110 may be a computing device, controlling device, server, or other processing circuitry that is configurable to communicate with the power tools 130 via the access point 120 to provide process controls. The line controller 110 may therefore include one or more processors and memory that may be configurable based on stored instructions or applications to direct operation of the power tools 130. As such, the line controller 110 may provide guidelines, safety limits, specific operating instructions, and/or the like to various ones of the power tools.

The access point 120 may be configured to interface with the line controller 110 and the power tools 130 via wireless communication. As such, for example, the access point 120 may be a component of or forming a wireless local area network (WLAN) or LAN for communication with other components of the network. The communications may be accomplished using Bluetooth, WiFi, HIPERLAN or other wavebands. Each of the access point 120, the power tools 130 and the line controller 110 may include a communications module having an antenna and corresponding transmit/receive circuitry for facilitating communication over the network. In some cases, the communications over the network may be secured with encryption and/or authentication techniques being employed by the communications modules at the respective components of the network.

FIG. 1 illustrates two power tools 130, but it should be appreciated that the system 100 may operate with one power tool or may operate with more than two power tools. Thus, two power tools are merely shown to exemplify the potential for multiplicity relative to the power tools 130 that could be employed with example embodiments. The power tools 130 may be configured to employ wired or wireless communication with the line controller 110 on a one way (e.g., from the line controller 110 to the power tools 130) or two-way basis. As such, for example, in some cases, usage data for logging or activity tracking may be provided back to the line controller 110 from the power tools 130 responsive to operation of the power tools 130. Moreover, in some cases, the two-way communication may be employed for step-by-step or activity based interactive instruction provision that can be conducted on a real-time basis.

Figure 2:
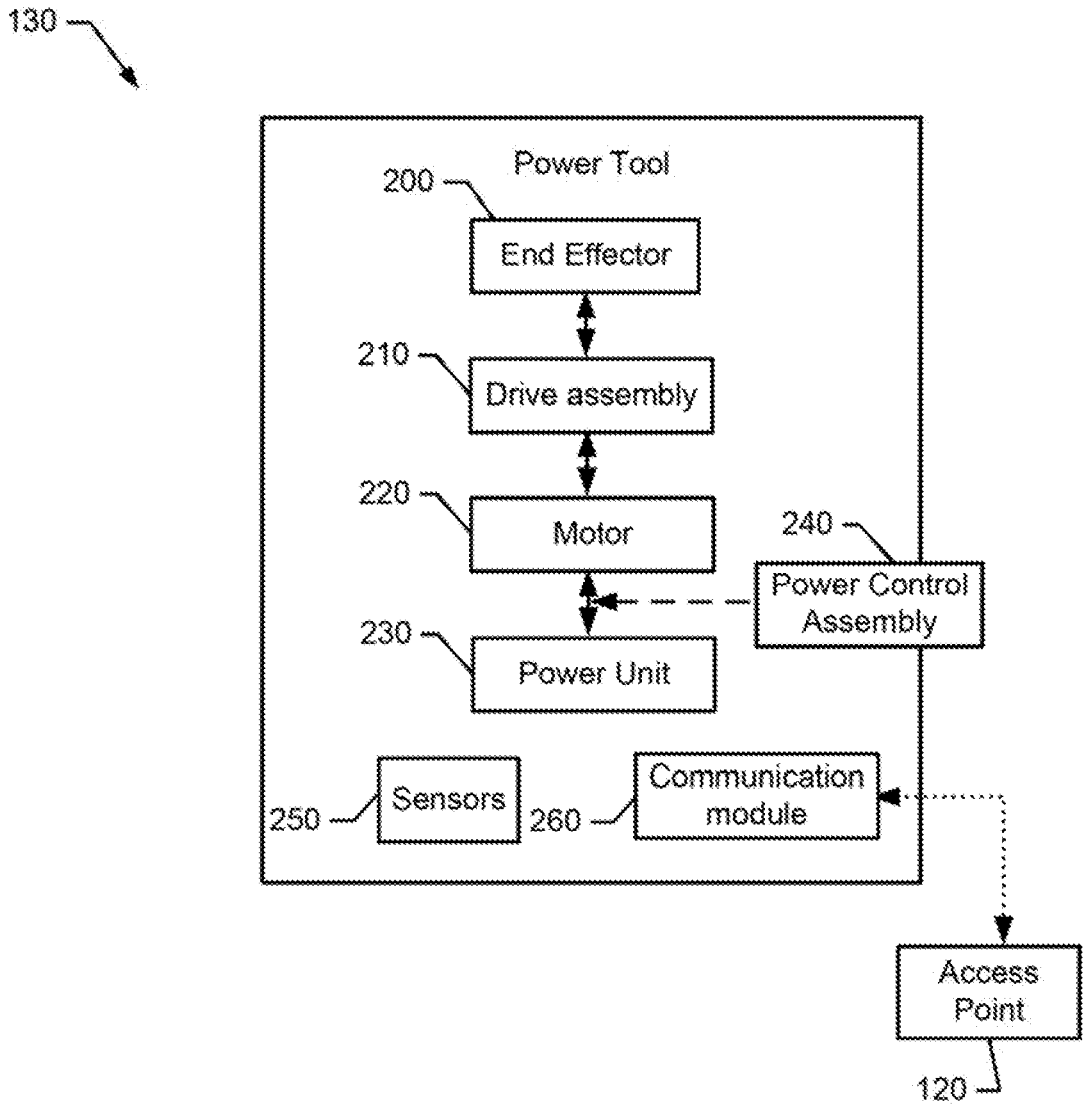
FIG. 2 illustrates a block diagram of components that may be employed in one of the power tools of FIG. 1 in accordance with an example embodiment.

FIG. 2 illustrates a block diagram of components that may be employed in one of the power tools 130 in accordance with an example embodiment. As shown in FIG. 2, the power tool 130 may include an end effector 200, a drive assembly 210 configured to drive the end effector 200, a motor 220 and a power unit 230. The power unit 230 may provide power for operation of the motor 220. When the motor 220 operates, the motor 220 may turn the drive assembly 210, which may in turn rotate the end effector 200 to perform a tightening operation. Control over the application of power to the motor 220, and therefore also control over the operation of the motor 220 and the power tool 130, may be provided via a power control assembly 240 (e.g., a trigger).

In some cases, the power tool 130 may further includes one or more sensors 250 and a communication module 260. However, such components need not be included in all embodiments. The motor 220 could be any type of motor. However, in an example embodiment, the motor 220 may be an AC or DC electric motor that is powered by an electric power source such as a battery or mains power. Thus, in an example embodiment, a power unit 230 from which the motor 220 is powered may be a removable and/or rechargeable battery pack housed within or attached to the housing of the power tool 130. However, the power unit 230 could be a source of pressurized air or other power source in various other example embodiments.

The communications module 260 (if employed) may include processing circuitry and corresponding communications equipment to enable the power tool 130 to communicate with the access point 120 using wireless communication techniques (as described above). However, in some cases, the communications module 260 may also include processing circuitry and corresponding communications equipment to support communication with the end effector 200. Although not shown, the power tool 130, the line controller 110 or the access point 120 may also include an LCD display for process parameter display, or for the display of other information associated with usage of the power tool 130. Alternatively or additionally, the power tool 130 may include lights or other indication components that can be operably coupled to the power control assembly 240, the power unit 230, the sensors 250, the motor 220, and/or the like in order to provide the operator with status information regarding such components.

In some cases, the end effector 200 or the power tool 130 may include one or more sensors 250, which may include strain gauges, thermocouples, Hall effect sensors, voltmeters, transducers, infrared sensors, RFID sensors, cameras, and/or the like for sensing physical characteristics about the end effector 200, the power tool 130 and components thereof, including information regarding operation or the local environment. These sensed characteristics may include, for example, torque applied by the power tool 130 or to a workpiece, temperature at the end effector 200, vibration of the end effector 200, angle of rotation of a spindle or other rotating portion of the end effector 200, the type of accessory or bit attached to the end effector 200, revolution count or rate of the end effector 200, and images or other information about the workpiece being operator on.

As shown in FIG. 2, the motor 220 may also be operably coupled to the power unit 230 so that the motor 220 can be selectively operated based on actuation of the power control assembly 240. Thus, the power control assembly 240 may be operably coupled to either or both of the power unit 230 and the motor 220, or inserted therebetween in an operational capacity in order to control the operation of the motor 220 based on a position or condition of the power control assembly 240. The motor 220 may then, in turn, operate the drive assembly 210. The drive assembly 210 may then act to drive the end effector 200 to perform the function for which the end effector 200 is configured.

In various example embodiments, the end effector 200 may be a fastening tool, a material removal tool, an assembly tool, or the like. Thus, for example, the end effector 200 may be a spindle with attachments, a nutrunner, torque wrench, socket driver, drill, grinder, and/or the like. The drive assembly 210 may include gearing and/or other drive components that convert the rotational forces transmitted by the motor 220 to perform the corresponding function of the end effector 200 for fastening, material removal and/or assembly. In one embodiment, the power tool 130 is configured to be handheld by the user and may include a handle and a trigger associated with the power control assembly 240 may be provided for controlling operation of the power tool 130.

In an example embodiment, the power control assembly 240 may be provided at a portion of the power tool 130 (e.g., the handle) that can allow the operator to ergonomically handle and actuate the power tool 130. Thus, for example, the power control assembly 240 may include a trigger that is physically structured to be actuated easily by the hand of the operator while holding the handle. However, there are a number of situations for which a purely binary operating characteristic that is either fully on or fully off dependent upon the position of the trigger would be undesirable. For example, if the motor 220 and end effector 200 only had a single operational speed at 100% of the capability of the power tool 130, it may be possible to damage objects being tightened if full engagement was not initially achieved. Thus, a socket may slip off a fastener, which could damage either. Accordingly, it may be desirable to permit the power tool 130 to apply a slower speed initially until engagement is confirmed before full speed is achieved. Furthermore, it may be desirable to allow two different ranges of motion of the trigger to be defined so that, for example, two corresponding different operational characteristics could be employed over the respective different ranges. In some cases, the operator may even be enabled to define the operational characteristics that apply to each range. Some example embodiments may be configured to provide this type of enhanced control.

Figure 3:
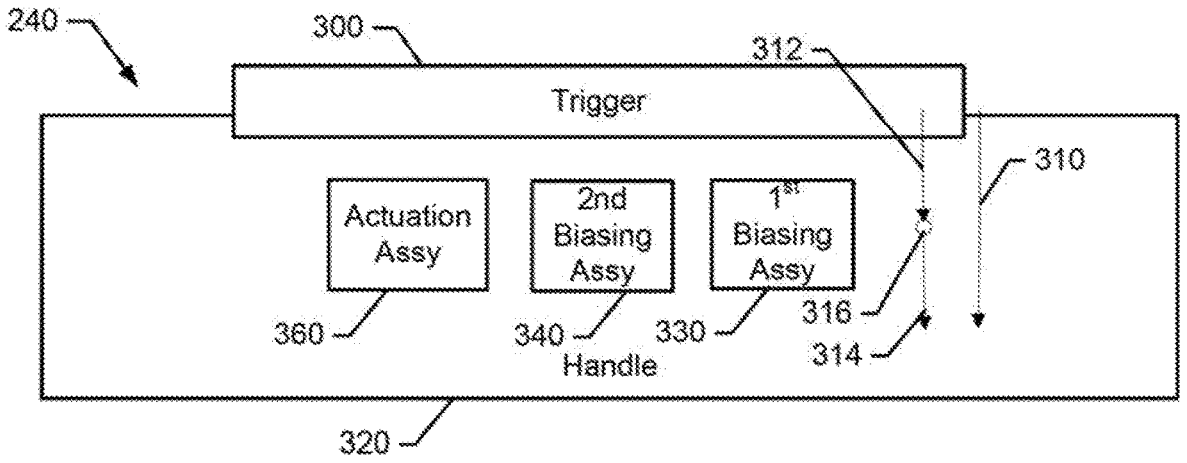
FIG. 3 illustrates a block diagram of a power control assembly of an example embodiment.

FIG. 3 illustrates a block diagram of the power control assembly 240 of an example embodiment. In this regard, the power control assembly 240 is configured to include a trigger 300 that is operable over a full range of motion 310 within handle 320. The full range of motion 310 may be achieved by depressing the trigger 300 (or a portion thereof) to either pivot the trigger 300 about a pivot axis or otherwise urge a body of the trigger 300 into the handle 320. The full range of motion 310 may be further divided into two regions. A first region 312 may cover a first (continuous) portion of the full range of motion 310 and a second region 314 may cover a second (and remaining, continuous) portion of the full range of motion 310. Thus, when the trigger 300 is depressed, the first region 312 is initially traversed by the trigger 300 and then the second region 314 is traversed to cover the full range of motion 310. In an example embodiment, a transition point 316 may be defined between the first region 312 and the second region 314. The transition point 316 may be used to cause an event when encountered, or may be used to distinguish between a first operational characteristic that may be applied for driving the power tool 130 (e.g., the end effector 200 of the power tool 130 via the operation of the motor 220) in the first region 312, and a second (and different) operational characteristic that may be applied for driving the power tool 130 in the second region 314.

The trigger 300 may be provided at a portion of the handle 320 or other part of the casing or housing of the power tool 130. The trigger 300 may be rotatable or capable of being depressed to initiate actuation of the trigger 300 over any portion of the full range of motion 310. The full range of motion 310 extends from a normal (non-actuated) position, which may be a rest position, to an actuated position. A first biasing assembly 330 may be provided to bias the trigger 300 to the normal position and the first biasing assembly 330 may be required to be overcome in order to move the trigger 300 from the normal position toward the actuated position. Thus, as the trigger 300 is depressed, the first biasing assembly 330 resists movement of the trigger 300 as the trigger 300 traverses the first region 312 at least until the transition point 316.

In an example embodiment, a second biasing assembly 340 may be provided to interface with the trigger 300 at least at the transition point 316. Thus, the second biasing assembly 340 may be encountered at the transition point 316. In some cases, the second biasing assembly 340 may interact with the trigger 300 only at the transition point 316. However, in alternative embodiments, the second biasing assembly 340 may interact with the trigger 300 after the transition point 316 (e.g., over the entire second region 314). In other words, the second biasing assembly 340 may interact with the trigger 300 (and therefore exert a force on the trigger 300) over only a portion of the full range of motion 310 of the trigger 300. Meanwhile, in some cases, the first biasing assembly 330 may interact with the trigger 300 over the full range of motion 310.

In this regard, for example, the second biasing assembly 340 may be disposed such that the trigger 300 feels resistance from only the first biasing assembly 330 in the first region 312, and then the trigger 300 begins to feel resistance from the second biasing assembly 340 at the transition point 316. After the transition point 316, the second biasing assembly 340 may either not interact with the trigger 300 (such that only the first biasing assembly 330 again interacts with the trigger 300 over the second region 314), or both the first and second biasing assemblies 330 and 340 may interact with the trigger 300 over the second region 314.

The transition point 316 may be defined in such a way as to provide at least a perceptible change in the amount of force needed to pass the transition point 316. In some cases, for example, a haptic feedback mechanism may be employed with or without audible feedback to let the operator know that the transition point 316 has been reached. A mechanical feedback or change may be experienced temporarily (i.e., only at the transition point 316) or over the second region 314 after the transition point 316 is reached and passed. The structures that can be used to define the transition point 316 will be described in greater detail below.

Movement of the trigger 300 also operates the power tool 130. Thus, movement of the trigger 300 may also, for example, cause operation of an actuation assembly 360. The actuation assembly 360 may be a portion of the power control assembly 240 and be operably coupled to electronic or other controls of the power tool 130 to enable the actuation of the trigger 300 to cause corresponding functionality of the motor 220 and therefore the power tool 130. The actuation assembly 360 may provide at least a primary response associated with operation of the power tool 130, and may also cause a secondary response in association with reaching or passing the transition point 316. In some examples, the primary response may include operation of the power tool 130 at a selected speed or angle of rotation. The secondary response may include operation of the power tool 130 at a different speed or angle of rotation relative to the speed/angle associated with the primary response. Alternatively or additionally, the secondary response may include driving another function associated with the power tool 130 such as, for example, activating one or more indicator or illuminating lights, activating one or more sensors, causing one or more pieces of information to be gathered, recorded or communicated, indexing the tool a selected number of degrees, or performing some other function.

FIG. 4 illustrates a cross section view of a handle portion of the power tool 130 in accordance with an example embodiment. As shown in FIG. 4, the trigger 300 may be pivotably mounted in the handle 320 such that at least one end of the trigger 300 can be depressed in the direction shown by arrow 400. As discussed above, movement of the trigger 300 may cause the actuation assembly 360 to operate. The actuation assembly 360 may include mechanical, electrical and/or electromagnetic components that may be configured to translate movement of the trigger 300 into corresponding controls for the power tool 130. In some cases, the actuation assembly 360 may include a movable cap 410 mounted on a cylindrical post 420. The cap 410 may be biased away from a base structure (of the handle 320) by the first biasing assembly 330, which in this case is embodied as a spring 430. The cap 410 may have a cutout portion defining a window 412. Meanwhile, a second spring 440 may be disposed within the post 420 to bias a first ball 442 upward (toward the trigger 300). The first ball 442 may exert a force on a second ball 444 to seat the second ball in a slot formed in a side of the post 420 that is substantially aligned with the window 412. The second ball 444 may be prevented from moving out of the slot in the post 420, but may be allowed to move inward toward an axial centerline of the post 420. The first ball 442, however, may exert a force on the second ball 444 to urge the second ball 444 toward a seated position in the slot and also to partially extend out the window 412. The first and second balls 442 and 444, and the second spring 440 may be portions of the second biasing assembly 340. FIGS. 5A, 5B, 5C and 5D show how the first and second balls 442 and 444 interact responsive to movement of the trigger 300 over the full range of motion 310.

Figure 5A:
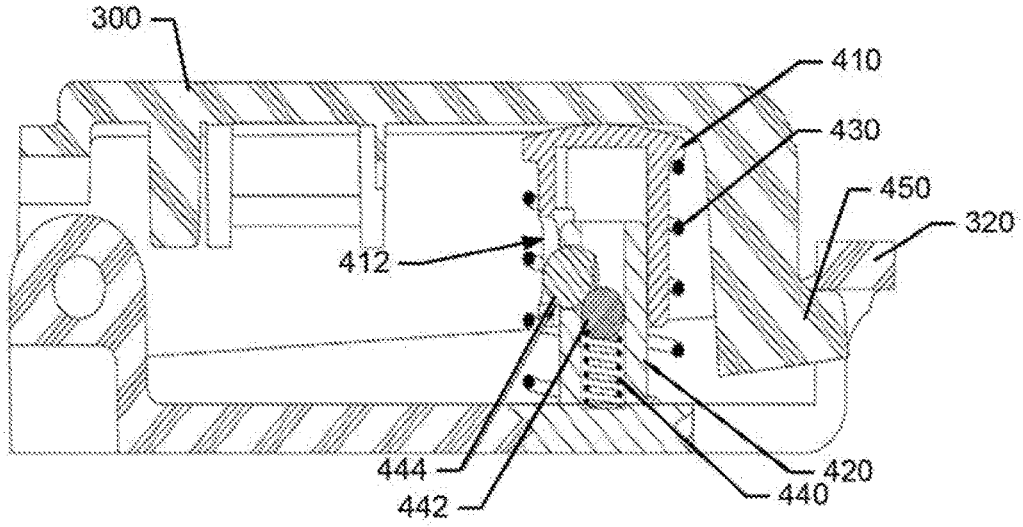

Referring to FIG. 5A, the trigger 300 is in the normal (i.e., rest) position. In this position, a foot 450 portion of the trigger 300 engages a portion of the housing of the handle 320 to prevent further outward motion of the trigger 300 responsive to the force exerted by the spring 430. The foot 450 may include a magnet 455 (see FIG. 4) disposed therein or proximate thereto for interaction with sensors of the actuation assembly 360 as described in greater detail below. When the foot 450 engages the handle 320, the trigger 300 is at the normal position and the spring 430 is fully extended to push the cap 410 against the trigger 300. In this position, the first ball 442 pushes the second ball 444 to a rest position extending partially out the window 412 responsive to biasing force from the second spring 440 on the first ball 442.

Figure 5B:
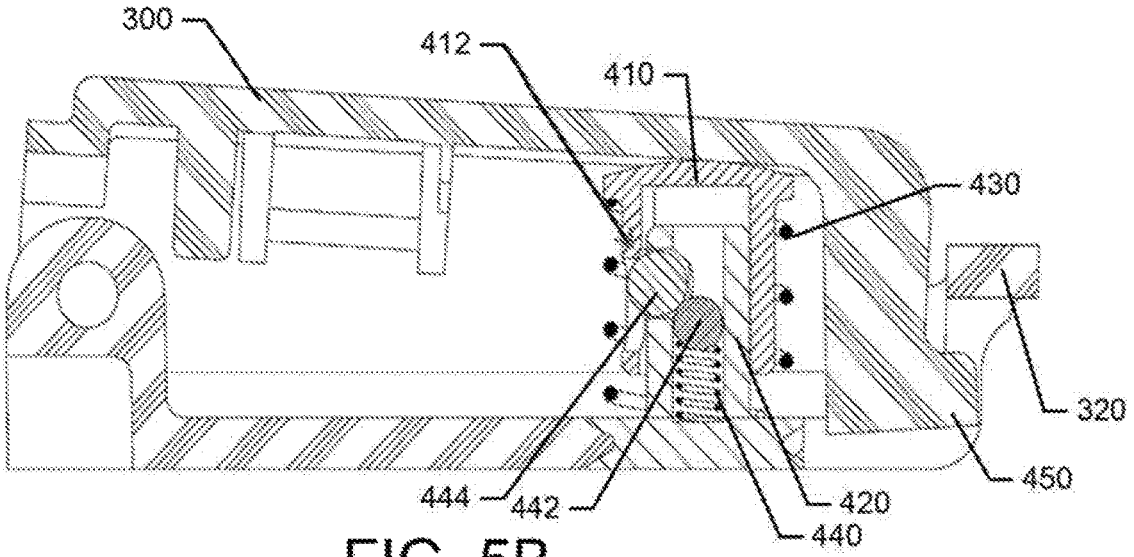
Figure 5C:
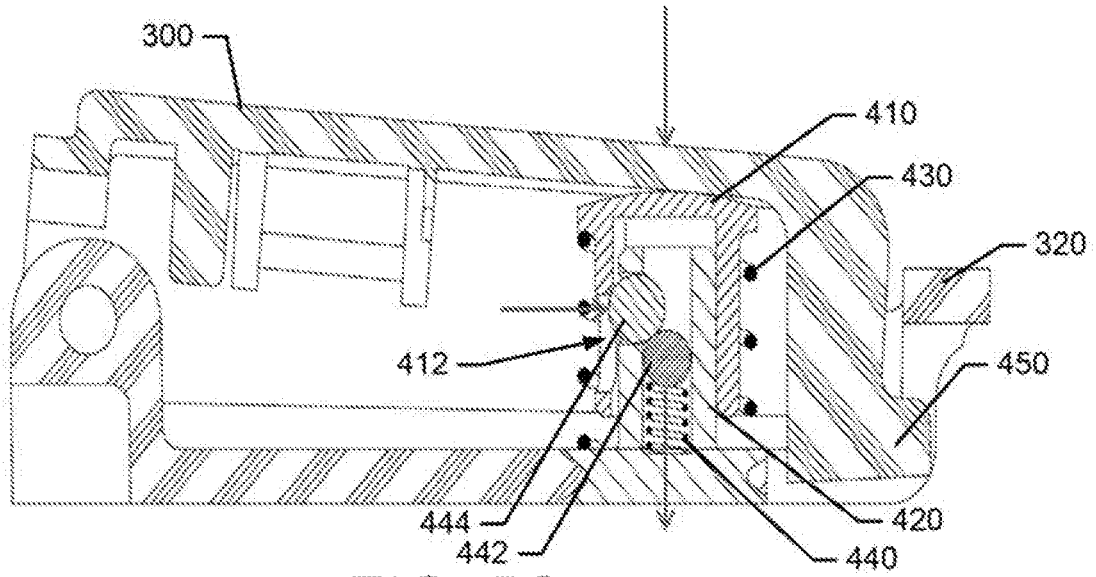
Figure 5D:
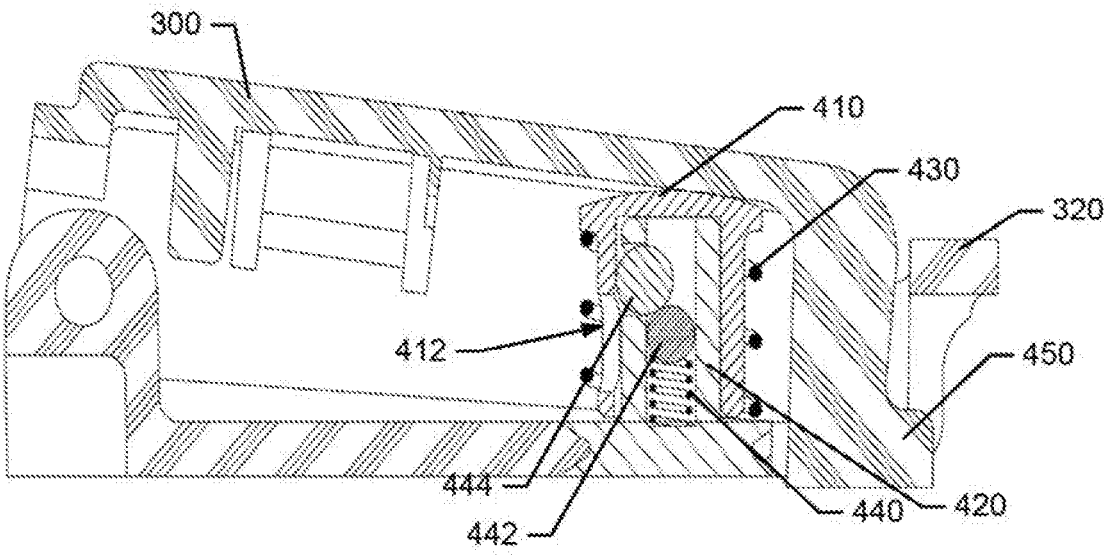

When the operator begins to press downward on the trigger 300, the spring 430 begins to be compressed as the foot 450 moves out of contact with the housing of the handle 320. FIG. 5B shows the moment at which the edge (i.e., the top edge) of the window 412 contacts the second ball 444. Once the edge of the window 412 contacts the second ball 444, any further compression of the trigger 300 and the spring 430 will begin to urge the second ball 444 inwardly toward the axial centerline of the post 420 and urge the first ball 442 downward. FIG. 5C illustrates the first ball 442 being displaced downward due to inward movement of the second ball 444 as the edge of the window 412 moves downward due to further compression of the trigger 300 and the spring 430. Finally, in FIG. 5D, the trigger 300 has reached the end of the full range of motion 310 described above in reference to FIG. 3. At this point, the spring 430 is fully compressed and poised to unload or decompress by urging the trigger 300 back to the normal or rest position when the operator releases pressure on the trigger 300. The cap 410 is at a lowest point of travel, and the second ball 444 and first ball 442 are at their farthest extents of movement in the inward and downward directions, respectively.

Referring now to FIG. 4, the power tool 130 may include a main circuit board 470 on which various electrical components associated with control of the power tool 130 may be mounted. In an example embodiment, portions of the actuation assembly 360 may be mounted on the main circuit board 470 to enable the position of the trigger 300 to be translated into electronic control inputs for the power control assembly 240 of FIG. 1. In an example embodiment, the actuation assembly 360 may include position sensors that are configured to detect a position of the trigger 300 to drive the motor 220 or other functions of the power tool 130 based on the detected position. In some examples, the position sensors may be embodied as a first Hall sensor 480 and a second Hall sensor 490. The first and second Hall sensors 480 and 490 may generate signals responsive to movement of the magnetic field generated by the magnet 455. Signals generated at the first and second Hall sensors 480 and 490 may be compared or otherwise used to determine the position along the full range of motion 310 of the trigger 300 at any given time or at various specific locations (e.g., at the normal position, at the actuated position, in the first region 312, in the second region 314, and/or at the transition point 316). Dependent upon the determined position of the trigger 300, the processing circuitry in the main circuit board 470 may be configured to provide the controls described above in association with the actuation assembly 360.

In the example of FIG. 4, the first and second Hall sensors 480 and 490 are disposed on opposite sides of the main circuit board 470. However, the first and second Hall sensors 480 and 490 could alternatively be located in some other desirable location that enables the position of the trigger 300 to be determined based on movement of the magnet 455.

As such, the second ball 444 may act as a detent to restrict movement of the cap 410 at the transition point 316 (which is defined by the position at which the window 412 edge hits the second ball 444) after the first region 312 is fully traversed. Once the detent position is passed, only the resistance of the spring 430 is felt, and the second region 314 is entered and can be traversed. The position of the trigger 300 (e.g., relative to the full range of motion 310) can be known via the first and second Hall sensors 480 and 490 sensing the magnet 455, and the desired function or functions may then be generated based on the position of the trigger 300. The detent position (i.e., the transition point 316) may be a position that marks a change in function (e.g., slow to fast, prepare for operation to operate, etc.) or the detent position may be a position that has its own function associated therewith (e.g., light one or more indicator or illumination lights, send information, record information, etc.).

Although the example of FIGS. 5A, 5B, 5C and 5D shows a situation where the second biasing assembly 340 only acts on the trigger 300 at the transition point 316, the second biasing assembly 340 could alternatively act in combination with the first biasing assembly 330 in some alternative embodiments. For example, FIG. 6 illustrates an example in which a standard ball plunger is used as the second biasing assembly 340. In this example, the main spring 600 is compressed as the trigger 300 is depressed similar to the manner described above. Meanwhile, a ball plunger 610 is disposed in contact with a portion of the trigger 300 to allow travel of the trigger 300 with opposition only by the main spring 600 over a first portion of the full range of motion of the trigger 300. Then, when the plunger in the ball of the ball plunger 610 contacts the support surface, the force of the main spring 600 and the spring in the ball plunger 610 each oppose further movement of the trigger 300. The point where the plunger contacts the support surface is the transition point 316 in this example.

FIGS. 7A, 7B and 7C illustrate another example in which the second biasing assembly 340 is embodied as a leaf spring 720. In this example, the main spring 700 is compressed as the trigger 300 is depressed similar to the manner described above. Meanwhile, a detent 710 (e.g., a 3 mm pin) is disposed at a position that enables contact between the leaf spring 720 and the detent at the transition point 316 as shown in FIG. 7A. Thus, only the main spring 700 opposes movement of the trigger 300 until the transition point 316 (as defined by the position of the detent 710) is reached as shown in FIG. 7B. Thereafter, the movement of the trigger 300 is opposed by both the main spring 700 and the leaf spring 720 as shown in FIG. 7C.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

The invention claimed is:

1. A power tool comprising:

an end effector configured to engage an object to be worked by the tool;

a power unit;

a drive assembly configured to drive the end effector responsive to application of input power thereto; and a motor configured to supply the input power to the drive assembly selectively based on operation of a power control assembly that controls coupling of the motor to the power unit, wherein the power control assembly includes a trigger having a full range of motion between a rest position and an actuated position, the power control assembly further defining a transition point between a first region and a second region of the full range of motion, wherein the power control assembly includes:

a first biasing assembly that opposes movement of the trigger in the first region, and a second biasing assembly that opposes movement of the trigger at least at the transition point, wherein the second biasing assembly comprises a spring, a first ball, and a second ball, and wherein motion of the trigger in the second region toward the actuated position moves the second ball in a first direction while the second ball is in direct engagement with the first ball to move the first ball in a second direction against a bias force of the spring;

wherein the first ball and the second ball are maintained in direct contact throughout the full range of motion of the trigger.

2. The power tool of claim 1, wherein in the first biasing assembly is configured to oppose movement of the trigger over the full range of motion of the trigger.

3. The power tool of claim 2, wherein the second biasing assembly is configured to oppose movement of the trigger only at the transition point.

4. The power tool of claim 2, wherein the second biasing assembly is configured to oppose movement of the trigger over the second region.

5. The power tool of claim 1, wherein the second ball extends at least partially through a window formed in a movable cap while the trigger moves through the first region, the cap being displaced responsive to movement of the trigger to contact the second ball and urge the second ball toward the first ball to compress the spring.

6. The power tool of claim 5, wherein the second ball is forced, via movement of the cap, out of the window and inside the cap after the transition point so that the second biasing assembly no longer resists movement of the trigger in the second region.

7. The power tool of claim 1, wherein the power control assembly comprises an actuation assembly configured to determine a position of the trigger to initiate a function of the power tool based the position of the trigger.

8. The power tool of claim 7, wherein the actuation assembly comprises a first Hall sensor and a second Hall sensor disposed to detect movement of a magnet disposed at a portion of the trigger;

wherein the first and second Hall sensors are disposed on opposite sides of a main circuit board of the power tool.

9. The power tool of claim 7, wherein the actuation assembly is configured to cause the drive assembly to move at a first speed over the first region and at a second speed over the second region, the first speed being lower than the second speed.

10. The power tool of claim 7, wherein the actuation assembly is configured to cause the drive assembly to move at a first speed over the second region and initiate a function not associated with movement of the drive assembly at the transition point.

11. The power tool of claim 7, wherein the actuation assembly is configured to actuate one or more indicator or illumination lights in response to the trigger passing the transition point.

12. The power tool of claim 7, wherein the actuation assembly is configured to actuate a first operational function over the first region and at a second operational function over the second region, the first and second operational functions being configurable by an operator of the power tool.

13. The power tool of claim 7, wherein the actuation assembly is configured to actuate an operator defined function in response to the trigger passing the transition point.

14. The power tool of claim 7, wherein the actuation assembly is configured to provide at least a primary response associated with operation of the power tool based on a position of the trigger, and cause a secondary response in association with reaching or passing the transition point.

15. The power tool of claim 14, wherein the primary response comprises operation of the power tool at a selected speed or angle of rotation, and wherein the secondary response comprises:

operation of the power tool at a different speed or angle of rotation relative to the speed or angle associated with the primary response, activating one or more indicator or illuminating lights, activating one or more sensors, causing one or more pieces of information to be gathered, recorded or communicated, or indexing the power tool a selected number of degrees.

16. The power tool of claim 2, wherein the power control assembly comprises an actuation assembly configured to determine a position of the trigger to initiate a function of the power tool based the position of the trigger.

17. A power tool comprising:

an end effector configured to engage an object to be worked by the tool;

a power unit;

a drive assembly configured to drive the end effector responsive to application of input power thereto; and a motor configured to supply the input power to the drive assembly selectively based on operation of a power control assembly that controls coupling of the motor to the power unit, wherein the power control assembly includes a trigger having a full range of motion between a rest position and an actuated position, the power control assembly further defining a transition point between a first region and a second region of the full range of motion, wherein the power control assembly includes:

a first biasing assembly that opposes movement of the trigger in the first region, a second biasing assembly that opposes movement of the trigger at least at the transition point, and an actuation assembly that translates movement of the trigger into corresponding functionality of the power tool, wherein the actuation assembly comprises a cylindrical post and a sliding cap disposed thereon, wherein a slot is cut into a curved side of the cylindrical post, and a window is cut into a curved side of the sliding cap such that the slot and the window are aligned to create a passageway from outside the sliding cap to inside the cylindrical post, wherein the second biasing assembly comprises a spring disposed inside and along an axis of the cylindrical post, a first ball urged toward the trigger by the spring, and a second ball in contact with the first ball, and wherein the second ball partially extends out of the window when the power control assembly is moving through the first region;

wherein, when the power control assembly is moving through the second region, the window slides out of alignment with the slot to push the second ball and, via direct engagement between the second ball and the first ball, the first ball against the bias force of the spring.

18. A power control assembly for controlling power delivery in a power tool, the power control assembly comprising:

a trigger moveable between a rest position and an actuated position, wherein the trigger moves through a transition point between a first region and a second region as the trigger moves from the rest position to the actuated position;

a first biasing assembly that opposes movement of the trigger in the first region;

a second biasing assembly that opposes movement of the trigger in the second region; and an actuation assembly that translates movement of the trigger into corresponding functionality of the power tool, wherein the second biasing assembly comprises a spring disposed inside and along an axis of a post, a first ball urged toward the trigger by the spring, and a second ball in contact with the first ball, wherein the second ball partially extends out of a slot in the post and a window in a sliding cap when the power control assembly is moving through the first region, and wherein, when the power control assembly is moving through the second region, the window in the sliding cap slides out of alignment with the slot in the post to cause an interior surface of the sliding cap to push the second ball and, via direct engagement between the second ball and the first ball, the first ball against the bias force of the spring.

19. The power tool of claim 18, wherein the first ball does not contact the sliding cap and the first ball moves in a parallel direction to the sliding cap.

20. The power tool of claim 18, wherein the bias force of the spring is not applied to the sliding cap when the second ball is moved out of the window of the sliding cap.

* * * * *